United States Patent [19]

Satomi et al.

[11] Patent Number: 4,723,995

[45] Date of Patent: Feb. 9, 1988

[54] METHOD FOR CONTINUOUSLY MANUFACTURING FIRED PELLETS

[75] Inventors: Koji Satomi, Tokyo; Tsuneo Miyashita, Yokohama; Hiroshi Saito, Tokyo; Noboru Sakamoto, Yokohama; Yoshihito Iwata, Tokyo, all of Japan

[73] Assignee: Nippon Kokan Kabushiki Kaisha, Tokyo, Japan

[21] Appl. No.: 870,730

[22] Filed: Jun. 4, 1986

[30] Foreign Application Priority Data

Jun. 27, 1985 [JP] Japan ..... 60-138996

[51] Int. Cl.[4] ..... C22B 1/16

[52] U.S. Cl. ..... 75/5; 75/3

[58] Field of Search ..... 75/5, 3, 4

[56] References Cited

U.S. PATENT DOCUMENTS

| | | | |
|---|---|---|---|
| 3,027,251 | 3/1962 | Koln et al. | 75/5 |
| 3,969,103 | 7/1976 | Capes | 75/3 |
| 4,231,797 | 11/1980 | Fujita et al. | 75/256 |
| 4,372,779 | 2/1983 | Sagiyama et al. | 75/3 |
| 4,504,306 | 3/1985 | Miyashita | 75/4 |

FOREIGN PATENT DOCUMENTS

| | | | |
|---|---|---|---|
| 435114 | 8/1969 | Australia . | |
| 1335860 | 7/1963 | France . | |
| 1462309 | 11/1966 | France . | |
| 55-27607 | 7/1980 | Japan . | |
| 58-9936 | 1/1983 | Japan . | |
| 58-53697 | 11/1983 | Japan . | |
| 0248827 | 12/1985 | Japan | 75/5 |
| 1036366 | 7/1966 | United Kingdom . | |
| 1139373 | 1/1969 | United Kingdom | 75/5 |
| 1,364,150 | 8/1974 | United Kingdom . | |

*Primary Examiner*—L. Dewayne Rutledge
*Assistant Examiner*—S. Kastler
*Attorney, Agent, or Firm*—Frishauf, Holtz, Goodman & Woodward

[57] ABSTRACT

A method for continuously manufacturing fired pellets, comprising the steps of: using raw materials comprising a first iron ore fine of from 30 to 70 wt. % and a second iron ore fine of from 70 to 30 wt. %, the first iron ore fine comprising an iron ore fine of from 50 to 80 wt. % having a particle size of up to 0.044 mm and an iron ore fine of from 50 to 20 wt. % having a particle size of from over 0.044 mm up to 0.5 mm, the second iron ore fine comprising an iron ore fine of from 40 to 70 wt. % having a particle size of from over 0.5 mm up to 8 mm and an iron ore fine of from 60 to 30 wt. % having a particle size of up to 0.5 mm; adding a powdery flux and water to the above-mentioned raw materials to form a mixture; forming the mixture into green pellets having a particle size of from 3 to 12 mm; covering the surfaces of the green pellets with a powdery solid fuel in a prescribed amount; and drying, igniting and then firing the green pellets in an endless travelling grate type firing furnace into fired pellets.

16 Claims, 6 Drawing Figures

METHOD FOR CONTINUOUSLY MANUFACTURING FIRED PELLETS

REFERENCE TO PATENTS, APPLICATIONS AND PUBLICATIONS PERTINENT TO THE INVENTION

As far as we know, there are available the following prior art documents pertinent to the present invention:

(1) Japanese patent provisional publication No. 58-9,936 dated Jan. 20, 1983;

(2) Japanese patent publication No. 55-27,607 dated July 22, 1980; and (3) Japanese patent publication No. 58-53,697 dated Nov. 30, 1983.

The contents of the above-mentioned prior art documents will be discussed hereafter under the heading of the "BACKGROUND OF THE INVENTION".

FIELD OF THE INVENTION

The present invention relates to a method for continuously manufacturing fired pellets, which comprises the steps of adding a powdery flux to raw materials comprising an iron ore fine (including dust mainly comprising iron oxides; the same applies thereafter) to form a mixture, forming the mixture into green pellets, and firing the thus formed green pellets in an endless travelling grate type firing furnace into fired pellets.

BACKGROUND OF THE INVENTION

There is an increasing demand for fired pellets as a raw material for blast furnace or direct-reduction iron-making. Fired pellets are usually manufactured as follows: adding a powdery flux to raw materials comprising an iron ore fine to form a mixture, forming the mixture into green pellets, and firing the thus formed green pellets into fired pellets. Many studies have been made to improve the quality of the fired pellets. For example, a method for continuously manufacturing fired pellets is disclosed in Japanese patent provisional publication No. 58-9,936 dated Jan. 20, 1983, which comprises the steps of:

using a raw material comprising an iron ore fine having a particle size of up to 5 mm; adding a powdery flux, a powdery solid fuel and water to said raw material to form a mixture; forming said mixture into green pellets having a particle size of from 10 to 20 mm; using an endless travelling grate type firing furnace comprising a first drying zone, a second drying zone following said first drying zone, an ignition zone following said second drying zone, a firing zone following said ignition zone, and an endless travelling grate passing sequentially through said zones; feeding said green pellets onto said endless travelling grate at the inlet side thereof; causing said green pellets on said endless travelling grate to travel sequentially through said first drying zone, said second drying zone, said ignition zone and said firing zone; blowing a first drying gas at a temperature of from 150° to 350° C. into said first drying zone from below upwardly to conduct a primary drying of said green pellets in said zone; blowing a second drying gas at a temperature of from 150° to 350° C. into said second drying zone from above downwardly to conduct a secondary drying of said green pellets in said zone; igniting said powdery solid fuel contained in said green pellets in said ignition zone; and downwardly sucking a combustion exhaust gas produced by combustion of said powdery solid fuel contained in said green pellets through said green pellets in said firing zone to heat said green pellets in said zone to a firing temperature, thereby firing said green pellets into fired pellets (hereinafter referred to as the "prior art 1").

The prior art 1 has the following problems:

(1) The raw material comprises an iron ore fine having a particle size of up to 5 mm, and the particle size distribution of the iron ore fine is not defined. Therefore, when an iron ore fine having a particle size of from over 0.5 mm up to 5 mm is present in the raw material in an amount of over 70 wt. %, the iron ore fine is hard to combine together when forming it into green pellets. As a result, the green pellets tend to easily disintegrate during transferring and firing thereof.

(2) When an iron ore fine having a particle size of up to 0.044 mm is present in the raw material in an amount of over 80 wt. %, the green pellets would have a higher bulk density. As a result, steam-bursting causes the green pellets to disintegrate when drying and firing the green pellets. In order to prevent disintegration of the green pellets caused by steam-bursting, in the prior art 1, the first drying zone and the second drying zone are provided in the upstream of the ignition zone of the endless travelling grate type firing furnace. In the first drying zone, the primary drying of the green pellets is conducted by means of the first drying gas blown upwardly from below, and in the second drying zone, the green pellets in this zone are subjected to the secondary drying by means of the second drying gas blown downwardly from above. However, since the first drying zone and the second drying zone are provided in the endless travelling grate type firing furnace as described above, a larger area in this firing furnace is required for drying the green pellets, with a decreased production efficiency of the green pellets and increased equipment and running costs.

(3) The green pellets have a particle size of from 10 to 20 mm. When firing the green pellets having such a large particle size into fired pellets, a difference in temperature is produced between the surface and the center portion of the green pellets, thus causing the green pellets to easily disintegrate.

(4) The fired pellets have a particle size of from about 10 to 20 mm just as the green pellets. When the fired pellets having such a large particle size are charged into a blast furnace, it takes much time for a reducing gas to penetrate into the center portion of the fired pellets. As a result, reducibility of the fired pellets in the blast furnace degrades, and the cores of the fired pellets remaining unreduced cause degradation of high-temperature property under load of the fired pellets.

Fired pellets with a limited particle size distribution of an iron ore fine are disclosed in Japanese patent publication No. 55-27,607 dated July 22, 1980, wherein:

a raw material for fired pellets comprises a first iron ore fine of under 70 wt. % and a second iron ore fine of at least 30 wt. %; said first iron ore fine contains at least 70 wt. % iron ore fine having a particle size of up to 0.044 mm, and has a basicity of at least 1.0; and said second iron ore fine has a particle size of from at least 0.177 mm up to 1.0 mm (hereinafter referred to as the "prior art 2").

The above-mentioned prior art 2 has the following problems:

(1) Since the second iron ore fine has a small particle size of from at least 0.177 mm up to 1.0 mm, the number of macro-pores in the fired pellets decreases, thus causing reducibility of the fired pellets charged into a blast furnace to degrade, and the cores of the fired pellets remaining unreduced cause degradation of high-temperature property under load of the fired pellets.

(2) As described above, the particle size of the second iron ore fine is limited within the range of from at least 0.177 mm up to 1.0 mm. In order to limit the particle size of the second iron ore fine to such a low level, it is necessary to finely crush the iron ore and conduct screening many times. As a result, crushing and screening of the iron ore require considerable expenses, resulting in a higher manufacturing cost.

A method for manufacturing lumpy fired pellets in which a plurality of fired pellets are combined into a lump, is disclosed in Japanese patent publication No. 58-53,697 dated Nov. 30, 1983, which comprises the steps of:

adding a powdery flux and water to a raw material comprising an iron ore fine to form a mixture; forming said mixture into green pellets having a prescribed particle size; covering the surfaces of said green pellets with a mixture of a powdery solid fuel and a powdery silica; firing said green pellets into fired pellets in an endless travelling grate type firing furnace; whereby, in said firing step, fayalite is formed on the surfaces of said fired pellets and said fayalite combines a plurality of said fired pellets into a lump (hereinafter referred to as the "prior art 3").

When the lumpy fired pellets manufactured according to the prior art 3, in which a plurality of fired pellets are combined into a lump, are charged into a blast furnace, the lumpy fired pellets have an advantage of not impairing smooth passage of a reducing gas because the lumpy fired pellets never flow preferentially into the center portion of the blast furnace and gaps are produced between the lumpy fired pellets. However, the prior art 3 has the following problem: the fired pellets manufactured according to the prior art 3 are combined into a lump by means of fayalite having a low reducibility. The lumpy fired pellets have therefore a low reducibility.

Under such circumstances, there is a strong demand for the development of a method for economically and continuously manufacturing fired pellets at a high yield, which have a high strength and an excellent reducibility, and do not impair smooth passage of a reducing gas in the blast furnace, and wherein green pellets do not disintegrate during transferring and firing thereof. However such a method has not as yet been proposed.

SUMMARY OF THE INVENTION

An object of the present invention is therefore to provide a method for economically and continuously manufacturing fired pellets at a high yield, which have a high strength and an excellent reducibility, and do not impair smooth passage of a reducing gas in the blast furnace, and wherein green pellets do not disintegrate during transferring and firing thereof.

In accordance with one of the features of the present invention there is provided a method for continuously manufacturing fired pellets, characterized by comprising the steps of:

using raw materials comprising a first iron ore fine of from 30 to 70 wt. % and a second iron ore fine of from 70 to 30 wt. %, said first iron ore fine comprising an iron ore fine of from 50 to 80 wt. % having a particle size of up to 0.044 mm and an iron ore fine of from 50 to 20 wt. % having a particle size of from over 0.044 mm up to 0.5 mm, said second iron ore fine comprising an iron ore fine of from 40 to 70 wt. % having a particle size of from over 0.5 mm up to 8 mm and an iron ore fine of from 60 to 30 wt. % having a particle size of up to 0.5 mm;

adding to said raw materials a powdery flux in a prescribed amount comprising at least one of quick lime, slaked lime, limestone and dolomite to form a mixture;

adding water in a prescribed amount to said mixture, and forming said mixture added with water into green pellets having a particle size of from 3 to 12 mm;

covering the surfaces of said green pellets with a powdery solid fuel in an amount of from 2.5 to 4.0 wt. % relative to the total amount of said raw materials and said powdery flux;

using an endless travelling grate type firing furnace comprising a drying zone, an ignition zone following said drying zone, a firing zone following said ignition zone and an endless travelling grate passing sequentially through said zones;

feeding said green pellets onto said endless travelling grate at the inlet side thereof with a thickness of from 300 to 1,500 mm;

causing said green pellets on said endless travelling grate to travel sequentially through said drying zone, said ignition zone and said firing zone in this order;

blowing a drying gas at a temperature of from 150 to 350° C. into said drying zone from above downwardly to dry said green pellets in said drying zone;

igniting said powdery solid fuel on the surfaces of said green pellets in said ingnition zone; and downwardly sucking a combustion waste gas produced by combustion of said powdery solid fuel on the surfaces of said green pellets through said green pellets in said firing zone to heat said green pellets in said firing zone to a firing temperature, thereby firing said green pellets into fired pellets.

DETAILED DESCRIPTION OF PREFERRED EMBODIMENT

Figure 1:
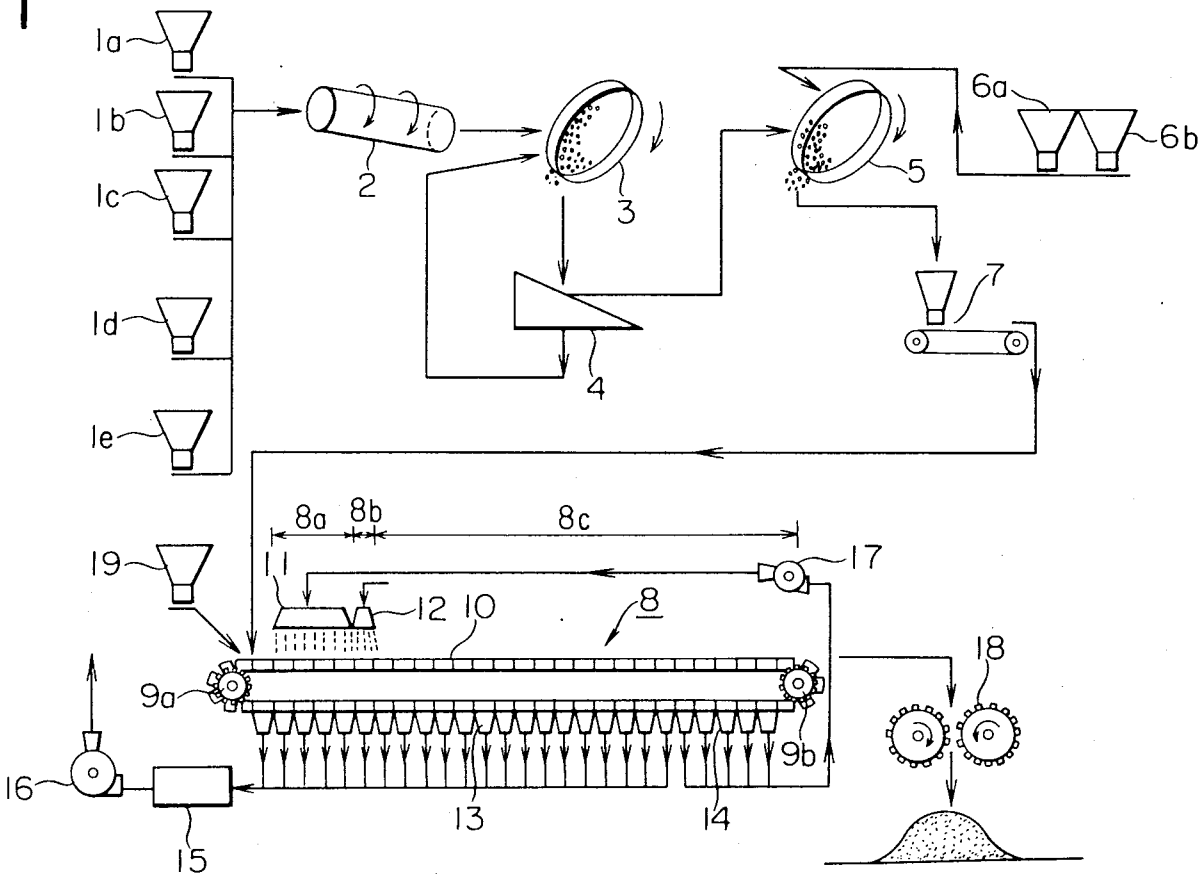
FIG. 1 is a schematic process diagram illustrating an embodiment of the method of the present invention.

From the above-mentioned point of view, we carried out extensive studies with a view to developing a method for economically and continuously manufacturing fired pellets at a high yield, which have a high strength and an excellent reducibility, and do not impair smooth passage of a reducing gas in the blast furnace, and wherein green pellets do not disintegrate during transferring and firing thereof.

As a result, we obtained the following finding: it is possible to economically and continuously manufacture fired pellets at a high yield, which have a high strength and an excellent reducibility, and do not impair smooth passage of a reducing gas in the blast furnace, and furthermore, it is possible to prevent green pellets from disintegrating during transferring and firing thereof, by using raw materials comprising a first iron ore fine of from 30 to 70 wt. % including an iron ore fine of from 50 to 80 wt. % having a particle size of up to 0.044 mm, and a second iron ore fine of from 70 to 30 wt. % including an iron ore fine of from 40 to 70 wt. % having a particle size of from over 0.5 mm up to 8 mm; adding a flux and water to said raw materials to form a mixture; forming said mixture into green pellets having a particle size of from 3 to 12 mm; covering the surfaces of said green pellets with a powdery solid fuel in a prescribed amount; and drying, igniting and then firing said green pellets in an endless travelling grate type firing furnace.

In the present invention, the first iron ore fine comprises an iron ore fine of from 50 to 80 wt. % having a particle size of up to 0.044 mm and an iron ore fine of from 50 to 20 wt. % having a particle size of from over 0.044 mm up to 0.5 mm for the following reason.

If the percentage of the iron ore fine having a particle size of up to 0.044 mm is under 50 wt. %, and the percentage of the iron ore fine having a particle size of from over 0.044 mm up to 0.5 mm is over 50 wt. %, the iron ore fine is hard to combine together when forming the green pellets. As a result, there occurs the problem of disintegration of the green pellets during transferring and firing thereof.

On the other hand, if the percentage of the iron ore fine having a particle size of up to 0.044 mm is over 80 wt. %, and the percentage of the iron ore fine having a particle size of from over 0.044 mm up to 0.5 mm is under 20 wt. %, the bulk density of the green pellets becomes higher. As a result, when drying and firing the green pellets in the endless travelling grate type firing furnace, steam-bursting of the green pellets occurs, thus causing the problem of disintegration of the green pellets. Furthermore, since the number of macro-pores in the fired pellets decreases, reducibility of the fired pellets charged into a blast furnace degrades, and the cores of the fired pellets remaining unreduced cause degradation of high-temperature property under load of the fired pellets.

If the particle size of the first iron ore fine is over 0.5 mm, the iron ore fine is hard to combine together when forming the green pellets. As a result, there occurs the problem of disintegration of the green pellets during transferring and firing thereof.

In the present invention, the second iron ore fine comprises an iron ore fine of from 40 to 70 wt. % having a particle size of from over 0.5 mm up to 8 mm and an iron ore fine of from 60 to 30 wt. % having a particle size of up to 0.5 mm for the following reason.

If the percentage of the iron ore fine having a particle size of from over 0.5 mm up to 8 mm is under 40 wt. % and the percentage of the iron ore fine having a particle size of up to 0.5 mm is over 60 wt. %, the bulk density of the green pellets becomes higher. As a result, when drying and firing the green pellets in the endless travelling grate type firing furnace, steam-bursting of the green pellets occurs, thus causing the problem of disintegration of the green pellets. Furthermore, since the number of macro-pores in the fired pellets decreases, reducibility of the fired pellets charged into a blast furnace degrades, and the cores of the fired pellets remaining unreduced cause degradation of high-temperature property under load of the fired pellets.

On the other hand, if the percentage of the iron ore fine having a particle size of from over 0.5 mm up to 8 mm is over 70 wt. %, and the percentage of the iron ore fine having a particle size of up to 0.5 mm is under 30 wt. %, the iron ore fine is hard to combine together when forming the green pellets. As a result, there occurs the problem of disintegration of the green pellets during transferring and firing thereof. Furthermore, when firing the green pellets into the fired pellets, much iron ore fine remaining unfired in the fired pellets causes the problem of degradation of reducibility of the fired pellets charged into a blast furnace.

If the particle size of the second iron ore fine is over 8 mm, the iron ore fine is hard to combine together when forming the green pellets, as described above, resulting in disintegration of the green pellets, and much iron ore fine remaining unfired in the fired pellets causes the problem of degradation of reducibility of the fired pellets.

In the present invention, the raw materials comprise the first iron ore fine of from 30 to 70 wt. % and the second iron ore fine of from 70 to 30 wt. % for the following reason.

If the percentage of the first iron ore fine is under, 30 wt. % and the percentage of the second iron ore fine is over 70 wt. %, the iron ore fine is hard to combine together when forming the green pellets. As a result, there occurs the problem of disintegration of the green pellets during transferring and firing thereof.

On the other hand, if the percentage of the first iron ore fine is over 70 wt. % and the percentage of the second iron ore fine is under 30 wt. %, the bulk density of the green pellets becomes higher. As a result, when drying and firing the green pellets in the endless travelling grate type firing furnace, steam-bursting of the green pellets occurs, thus causing the problem of disintegration of the green pellets. Furthermore, since the number of macro-pores in the fired pellets decreases, reducibility of the fired pellets charged into a blast furnace degrades, and the cores of the fired pellets remaining unreduced cause degradation of high-temperature property under load of the fired pellets. In addition, the surfaces of the green pellets and the surfaces of the fired pellets obtained by firing the green pellets become smooth without irregularities. As a result, when the fired pellets having such surfaces are charged into the blast furnace, the fired pellets flow preferentially into the center portion of the blast furnace and gaps between the fired pellets decrease, so that there occurs the problem of impairing smooth passage of a reducing gas in the blast furnace.

In the present invention, the powdery flux to be added to the above-mentioned raw materials comprises at least one of quick lime, slaked lime, limestone and dolomite, and the amount of addition thereof is determined on the basis of the amount of silica contained in the iron ore fine as the raw materials. Among the above-mentioned fluxes, quick lime and slaked lime have at the same time the function as a binder. When using as the flux at least one of limestone and dolomite, it is necessary to simultaneously add a binder to the raw materials. A powdery solid fuel comprising at least one of coke breeze, coal fine, char fine and powdery petroleum coke may be added to the raw materials. By adding the powdery solid fuel, together with the powdery flux, to the raw materials, it is possible to increase strength of the fired pellets.

In the present invention, the particle size of the green pellets is limited within the range of from 3 to 12 mm for the following reason.

If the particle size of the green pellets is under 3 mm, smooth passage of the high-temperature firing gas is impaired when firing the green pellets into the fired pellets in the endless travelling grate type firing furnace, resulting in the problem of a lower productivity of the fired pellets. In addition, because the particle size of the fired pellets is also under 3 mm, the fired pellets with such a small particle size, if charged into the blast furnace, lead to impairing of smooth passage of the reducing gas. As a result, scaffolds and slips are produced in the blast furnace, causing the problem of unstable blast furnace operations.

On the other hand, if the particle size of the green pellets is over 12 mm, impact resistance of the green pellets decreases, so that, when transferring the green pellets into the endless travelling grate type firing furnace, there causes the problem of disintegration of the green pellets. In addition, since the particle size of the fired pellets is also over 12 mm, when the fired pellets with such a large particle size are charged into the blast furnace, it takes much time for a reducing gas to penetrate up to the center portions of the fired pellets. As a result, reducibility of the fired pellets in the blast furnace decreases, and the cores of the fired pellets remaining unreduced cause the problem of degradation of high-temperature property under load of the fired pellets. The green pellets should preferably have a particle size of from 5 to 10 mm.

In the present invention, the surfaces of the green pellets are covered with a powdery solid fuel in an amount of from 2.5 to 4.0 wt. % relative to the total amount of the raw materials and the powdery flux for the following reason.

By covering the surfaces of the green pellets with a powdery solid fuel, it is possible to increase the firing efficiency of the green pellets in the endless travelling grate type firing furnace, and hence to fire the green pellets into the fired pellets having a high strength in a short period of time. However, if the covering amount of the powdery solid fuel is under 2.5 wt. % relative to the total amount of the raw materials and the powdery flux, a desired effect as described above cannot be obtained. On the other hand, if the covering amount of the powdery solid fuel is over 4.0 wt. % relative to the total amount of the raw materials and the powdery flux, the temperature of the green pellets during firing in the endless travelling grate type firing furnace becomes excessively high. As a result, the structure of the fired pellets becomes excessively dense, thus causing the problem of degradation of reducibility of the fired pellets charged into the blast furnace.

At least one of coke breeze, coal fine, char fine and powdery petroleum coke is used as the powdery solid fuel. The surfaces of the green pellets may be covered with a mixture of the powdery solid fuel and the powdery flux. By covering the surfaces of the green pellets with the mixture of the powdery solid fuel and the powdery flux, the fired pellets are easily combined into a large slab-shaped mass when firing the green pellets into the fired pellets.

In the present invention, firing of the green pellets is carried out by the use of an endless travelling grate type firing furnace comprising a drying zone, an ignition zone following the drying zone, a firing zone following the ignition zone and an endless travelling grate passing sequentially through these zones.

The thickness of the green pellets fed onto the inlet side of the endless travelling grate is limited within the range of from 300 to 1,500 mm for the following reason. With a thickness of the green pellets of under 300 mm, draft resistance becomes smaller when firing the green pellets into the fired pellets in the firing zone. As a result, the flow rate of a combustion waste gas as a firing gas sucked downwardly through the green pellets in the firing zone becomes higher. Therefore, combustion of the powdery solid fuel covering the surfaces of the green pellets comes prematurely to an end, thus causing the problem of insufficient firing of the green pellets. On the other hand, with a thickness of the green pellets of over 1,500 mm, water contained in the green pellets condenses on the surfaces of the green pellets in the lower layers in the firing zone when firing the green pellets into fired pellets in the firing zone. As a result, there occurs the problem of disintegration of the green pellets in the lower layers. The above-mentioned thickness of the green pellets does not include that of a hearth layer ore.

In the present invention, drying of the green pellets is carried out by blowing a drying gas at a temperature of from 150° to 350° C. downwardly from above into the drying zone. The purpose of drying of the green pellets is to prevent the green pellets from bursting and disintegrating under the effect of heat shock when igniting the powdery solid fuel on the surfaces of the green pellets in the ignition zone. Therefore, it suffices to dry only the surface portions of the green pellets fed onto the endless travelling grate. As described previously with reference to the prior art 1, it has been the conventional practice to fully dry the green pellets fed onto the endless travelling grate by providing a first drying zone and a second drying zone in the endless travelling grate type firing furnace, subjecting the green pellets to the primary drying in the first drying zone, and then subjecting the green pellets to the secondary dryingin the second drying zone. As against this conventional practice, it suffices, in the present invention, to dry only the surface portions of the green pellets fed onto the endless travelling grate for the following reason. The green pellets have a relatively small particle size and the raw materials include the iron ore fine having a particle size of from over 0.5 mm up to 8 mm in a prescribed amount. Therefore, when firing the green pellets into the fired pellets, steam-bursting does not occur and the green pellets never disintegrate.

The temperature of the drying gas is limited within the range of from 150° to 350° C. for the following reason. A temperature of the drying gas of under 150° C. cannot give a desired effect of drying. If the temperature of the drying gas is over 350° C., on the other hand, steam-bursting of the green pellets occurs, thus causing the problem of disintegration of the green pellets when drying the green pellets. The combustion waste gas sucked in the downstream of the firing zone is adapted to be used as a drying gas. It is therefore desirable for the effective utilization of waste heat to use the combustion waste gas as the drying gas.

Now, the method of the present invention is described with reference to the drawings.

FIG. 1 is a schematic process diagram illustrating an embodiment of the method of the present invention. As shown in FIG. 1, the first iron ore fine and the second iron ore fine having the above-mentioned particle size distributions are stored in storage tanks 1*a*, 1*b* and 1*c*. A powdery flux is stored in a storage tank 1*d*, and a powdery solid fuel is stored in a storage tank 1*e*. The first iron ore fine in a prescribed amount and the second iron ore fine in a prescribed amount discharged from the storage tanks 1*a*, 1*b* and 1*c*, the powdery flux in a prescribed amount discharged from the storage tank 1*d* and the powdery solid fuel in a prescribed amount discharged as required from the storage tank 1*e* are fed to a mixer 2 and are mixed in the mixer 2 rotating at prescribed revolutions to form a mixture.

The mixture formed in the mixer 2 is fed to a first pelletizer 3 of the disk type, and water in a prescribed amount is added to the mixture in the first pelletizer 3. The mixture thus added with water is formed into green pellets having a particle size of from 3 to 12 mm by means of the first pelletizer 3 rotating at prescribed revolutions. In order to conduct effective formation of the green pellets in the first pelletizer 3, the water content in the mixture should preferably be up to 5 wt. %. The green pellets formed by means of the first pelletizer 3 are sieved through a screen 4. The green pellets on the screen are fed to a second pelletizer 5 of the disk type, and the green pellets under the screen are fed back to the first pelletizer 3.

Another powdery solid fuel for covering the surfaces of the green pellets is stored in a storage tank 6*a* and another powdery flux is stored in a storage tank 6*b*. The another powdery solid fuel in a prescribed amount discharged from the storage tank 6*a* and the another powdery flux in a prescribed amount discharged as required from the storage tank 6*b* are fed to the second pelletizer 5. By means of the second pelletizer 5 rotating at prescribed revolutions, the surfaces of the green pellets fed from the first pelletizer 3 to the second pelletizer 5 are covered with the powdery solid fuel in a prescribed amount or with a mixture of the powdery solid fuel and the powdery flux in prescribed amounts. The first pelletier 3 and the second pelletizer 5 are not limited to the disk type, but may be of the drum type as well. The green pellets, of which the surfaces are covered with the powdery solid fuel or with the mixture of the powdery solid fuel and the powdery flux as described above, are transferred through a feeder 7 to an endless travelling grate type firing furnace 8.

The endless travelling grate type firing furnace 8 comprises a drying zone 8*a*, an ignition zone 8*b* following the drying zone 8*a*, a firing zone 8*c* following the ignition zone 8*b*, and an endless travelling grate 10 passing sequentially through these zones. Reference numerals 9*a* and 9*b* indicate a pair of pulleys for causing the endless travelling grate 10 to travel. The drying zone 8*a* is provided with a drying oven 11 having a drying gas blowing port directed downwardly. The drying oven 11 blows a drying gas at a temperature of from 150° to 350° C. downwardly from above into the drying zone 8*a* to dry the green pellets in this zone. The ignition zone 8*b* is provided with an ignition oven 12 having an ignition gas blowing port directed downwardly for igniting the powdery solid fuel on the surfaces of the green pellets. The ignition oven 12 blows an igniting gas upwardly from below into the ignition zone 8*b* to ignite the powdery solid fuel on the surfaces of the green pellets in this zone.

In FIG. 1, 13 are a pluarlity of first wind boxes provided below the endless travelling grate 10 travelling in the upstream of the endless travelling grate type firing furnace 8, and 14 are a plurality of second wind boxes provided below the endless travelling grate 10 travelling in the downstream of the endless travelling grate type firing furnace 8. The drying gas blown into the drying zone 8*a*, the ignition gas blown into the ignition zone 8*b*, and part of the combustion waste gas produced by combustion of the powdery solid fuel on the surfaces of the green pellets in the firing zone 8*c* are sucked by a first blower 16 through the plurality of first wind boxes 13 and a dust collector 15, and released to open air. The remaining part of the combustion waste gas produced by combustion of the powdery solid fuel on the surfaces of the green pellets in the firing zone 8*c* is sucked by a second blower 17 through the plurality of second wind boxes 14, and blown into the drying oven 11 of the drying zone 8*a* as the drying gas.

In FIG. 1, 18 is a crusher arranged near the downstream end of the endless travelling grate 10. The crusher 18 crushes a large slab-shaped mass of the fired pellets discharged from the downstream end of the endless travelling grate 10. Also in FIG. 1, 19 is a storage tank arranged near the upstream end of the endless travelling grate 10. A hearth layer ore to be fed onto the endless travelling grate 10 is stored in the storage tank 19.

The green pellets, of which the surfaces are covered with the powdery solid fuel or with the mixture of the powdery solid fuel and the powdery flux, are fed with a thickness of from 300 to 1,500 mm onto the hearth layer ore on the endless travelling grate 10, and are caused to travel, on the endless travelling grate 10, sequentially through the drying zone 8*a*, the ignition zone 8*b* and the firing zone 8*c* in this order. The drying gas at a temperature of from 150° to 350° C. is blown downwardly from above through the drying oven 11 into the drying zone 8*a* to dry the green pellets in this zone. Then, a high-temperature combustion waste gas produced for example through combustion of a fuel such as a coke oven gas is blown as the ignition gas downwardly from above through the ignition oven 12 into the ignition zone 8*b* to ignite the powdery solid fuel on the surfaces of the green pellets in this zone. Then, the high-temperature combustion waste gas produced by combustion of the powdery solid fuel on the surfaces of the green pellets is sucked by the first blower 16 and the second blower 17 downwardly through the green pellets in the firing zone 8*c* to heat the green pellets in this zone to a firing temperature, thereby firing the green pellets into the fired pellets. In the firing step as described above in the firing zone 8*c*, at least one of calcium ferrite and slag excellent in reducibility is formed on the surface portions of the fired pellets, which combines the fired pellets into a large slab-shaped mass.

The thus formed large slab-shaped mass of the fired pellets is discharged from the downstream end of the endless travelling grate 10, crushed by means of the crusher 18, and sieved through a screen not shown. Pieces of the fired pellets under the screen having a particle size of under 3 mm are transferred to a storage tank for storing a return ore.

Figure 2A:
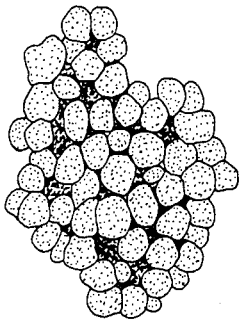
FIG. 2(A) is a schematic view of lumpy fired pellets manufactured according to the method of the present invention, in which a plurality of fired pellets are combined into a lump.
Figure 2B:
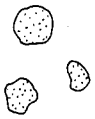
FIG. 2(B) is a schematic view of individual fired pellets manufactured according to the method of the present invention.

FIGS. 2(A) and 2(B) are schematic views of the fired pellets manufactured according to the method of the present invention. FIG. 2(A) illustrates lumpy fired pellets in which a plurality of fired pellets are combined into a lump by at least one of calcium ferrite and slag formed on the surfaces of the fired pellets, obtained by crushing the large slab-shaped mass by means of the crusher 18. FIG. 2(B) illustrates the individual fired pellets, obtained by crushing the large slab-shaped mass by means of the crusher 18. As shown in FIGS. 2(A) and 2(B), the fired pellets manufactured according to the method of the present invention have an irregular shape not only in the form of a lump but also in the form of a single pellet. When charged into a blast furnace, therefore, the fired pellets do not flow preferentially into the center portion of the blast furnace, and in addition, smooth passage of a reducing gas is not impaired because gaps are produced between the fired pellets.

The fired pellets manufactured according to the method of the present invention have an irregular shape as described above because of an irregular shape of the green pellets formed from the raw materials comprising the first iron ore fine including an iron ore fine of from 50 to 80 wt. % having a particle size of up to 0.044 mm and the second iron ore fine including an iron ore fine of from 40 to 70 wt. % having a particle size of from over 0.5 mm up to 8 mm.

As described above, one of calcium ferrite and slag excellent in reducibility is formed on the surface portions of the fired pellets manufactured according to the method of the present invention. Therefore, unlike the fired pellets manufactured according to the prior art 3, in which fayalite impairing reducibility of the fired pellets in the blast furnace is formed on the surface portions of the fired pellets, the fired pellets manufactured according to the method of the present invention have an excellent reducibility.

Furthermore, the lumpy fired pellets manufactured according to the method of the present invention, in which a plurality of fired pellets are combined into a lump, even if integrating under the impact during transferring, are only separated into individual fired pellets as shown in FIG. 2(B). Therefore, disintegration of the lumpy fired pellets as mentioned above never impairs satisfactory use as the fired pellets.

Figure 3:
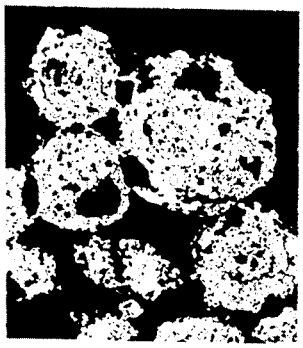
FIG. 3 is a microphotograph (five magnifications) showing the structure of the lumpy fired pellets manufactured according to the method of the present invention.
Figure 4:
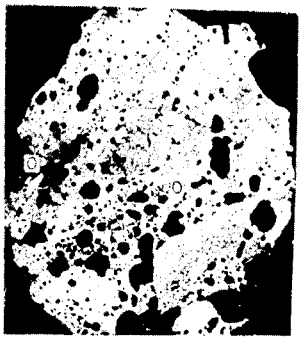
FIG. 4 is a microphotograph (five magnifications) showing the structure of the conventional sinter.
Figure 5:
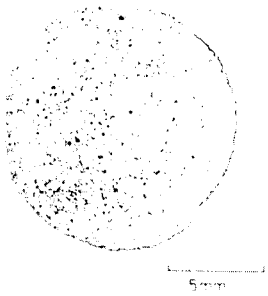
FIG. 5 is a microphotograph (five magnifications) showing the structure of the fired pellet manufactured according to the conventional method.

FIG. 3 is a microphotograph (five magnifications) showing the structure of the lumpy fired pellets manufactured according to the method of the present invention in which a plurality of fired pellets are combined into a lump; FIG. 4 is a microphotograph (five magnifications) showing the structure of the conventional sinter; and FIG. 5 is a microphotograph (five magnifications) showing the structure of the fired pellet manufactured according to the conventional method, using the raw materials including an iron ore of over 80 wt. % having a particle size of up to 0.044 mm. As shown in FIG. 3, the lumpy fired pellets manufactured according to the method of the present invention are higher in porosity and comprise the smaller individual fired pellets as compared with the conventional sinter shown in FIG. 4 and the conventional fired pellet shown in FIG. 5, and contain smaller melted structure portions (white portions) and smaller portions with unreduced iron ore fine (portions marked by "0") as compared with the conventional sinter shown in FIG. 4. Therefore, the lumpy fired pellets manufactured according to the method of the present invention have a higher reducibility in the blast furnace than the conventional sinter and the conventional fired pellet.

Now, the method of the present invention is described in more detail by means of examples.

EXAMPLE 1

Raw materials comprising a first iron ore fine in an amount of 40 wt. % having a particle size distribution as shown in Table 1 and a chemical composition as shown in Table 2, and a second iron ore fine in an amount of 60 wt. % having a particle size distribution as shown in Table 3 and a chemical composition as shown in Table 4 were used.

TABLE 1

| From over 0.125 mm up to 0.5 mm (wt. %) | From over 0.044 mm up to 0.125 mm (wt. %) | Up to 0.044 mm (wt. %) |
|---|---|---|
| 2.79 | 31.04 | 66.17 |

TABLE 2

| T.Fe (wt. %) | $SiO_2$ (wt. %) | $Al_2O_3$ (wt. %) |
|---|---|---|
| 68.32 | 0.28 | 0.73 |

TABLE 3

| From over 2.83 mm up to 8 mm (wt. %) | From over 2.00 mm up to 2.83 mm (wt. %) | From over 1.00 mm up to 2.00 mm (wt. %) | From over 0.50 mm up to 1.00 mm (wt. %) | From over 0.125 mm up to 0.50 mm (wt. %) | From over 0.044 mm up to 0.125 mm (wt. %) | Up to 0.044 mm (wt. %) |
|---|---|---|---|---|---|---|
| 10.01 | 10.78 | 21.68 | 14.72 | 27.09 | 11.48 | 4.24 |

TABLE 4

| T.Fe (wt. %) | $SiO_2$ (wt. %) | $Al_2O_3$ (wt. %) |
|---|---|---|
| 56.71 | 5.94 | 2.81 |

The above-mentioned raw materials stored in the storage tanks 1*a*, 1*b* and 1*c* were fed to the mixer 2. Quick lime fine having a particle size distribution as shown in Table 5 stored in the storage tank 1*d*, and coke breeze having a particle size distribution as shown in Table 5 stored in the storage tank 1*e* were added to the raw materials in the mixer 2 at ratios shown also in Table 5. Then, the mixer 2 was rotated at prescribed revolutions to form a mixture.

TABLE 5

| | Particle size distribution (wt. %) | | | | Ratio of addition to raw materials (wt. %) |
|---|---|---|---|---|---|
| | From over 1 mm up to 10 mm | From over 0.5 mm up to 1 mm | From over 0.125 mm up to 0.5 mm | Up to 0.125 mm | |
| Quick lime fine | 45.5 | 18.3 | 20.0 | 16.2 | 2.7 |
| Coke breeze | 2.9 | 4.5 | 49.4 | 43.2 | 1.0 |

The mixture formed in the mixer 2 was fed to the first pelletizer 3, and water was added to the mixture in the first pelletizer 3. The mixture thus added with water was formed into green pellets having a particle size distribution as shown in Table 6 and having a water content of 8 wt. % by the first pelletizer 3 rotating at prescribed revolutions.

TABLE 6

| From over 10 mm up to 12 mm (wt. %) | From over 9 mm up to 10 mm (wt. %) | From over 7 mm up to 9 mm (wt. %) | From over 5 mm up to 7 mm (wt. %) | From 3 mm up to 5 mm (wt. %) |
|---|---|---|---|---|
| 8 | 11 | 39 | 35 | 7 |

The thus formed green pellets were fed to the second pelletizer 5, and coke breeze having a particle size distribution as shown in Table 5 stored in the storage tank 6a and quick lime fine having a particle size distribution as shown in Table 5 stored in the storage tank 6b were fed to the second pelletizer 5. The amount of fed coke breeze was 2.7 wt. % relative to the total amount of the raw materials, the quick lime fine and the coke breeze composing the green pellets, and the amount of fed quick lime fine was 3.3 wt. % relative to the above-mentioned total amount. The surfaces of the green pellets in the second pelletizer 5 were covered with a mixture of the coke breeze and the quick lime fine by means of the second pelletizer 5 rotating at prescribed revolutions. Table 7 shows conditions of the first pelletizer 3 and the second pelletizer 5.

TABLE 7

| | First pelletizer | Second pelletizer |
|---|---|---|
| Type | Disk type | Disk type |
| Revolutions (rpm) | 12 | 12 |
| Inclination angle | 44° | 44° |

Hearth layer ore stored in the storage tank 19 was fed with a thickness of 50 mm onto the endless travelling grate 10 at the inlet side thereof. Then, the green pellets, of which the surfaces were covered with the mixture of quick lime fine and coke breeze, were fed with a thickness of 400 mm onto the hearth layer ore on the endless travelling grate 10 on the inlet side thereof. The green pellets were caused to travel, on the endless travelling grate 10, sequentially through the drying zone 8a, the ignition zone 8b and the firing zone 8c in this order.

A drying gas at a temperature of about 250° C. was blown downwardly from above into the drying zone 8a to dry the green pellets travelling through this zone. Then, a combustion waste gas at a temperature of about 1,100° C. obtained by combustion of coke oven gas was blown, as an ignition gas, downwardly from above into the ignition zone 8b to ignite coke breeze on the surfaces of the green pellets travelling through this zone. Then, a high-temperature combustion waste gas produced by combustion of coke breeze on the surfaces of the green pellets was sucked, as a firing gas, under the negative pressure of 350 mmAq by means of the first blower 16 and the second blower 17, downwardly through the green pellets travelling through the firing zone 8c to heat the green pellets travelling through this zone to a firing temperature of about 1,350° C., thereby firing the green pellets into the fired pellets.

The travelling periods of time of the green pellets through the drying zone 8a, the ignition zone 8b and the firing zone 8c were 3 minutes, 1 minute and 18 minutes, respectively. In Example 1, part of the above-mentioned firing gas was sucked by the second blower 17 through the plurality of wind boxes 14, and blown into the drying zone 8a as the drying gas.

Large slab-shaped masses of the fired pellets thus obtained were discharged from the downstream end of the endless travelling grate 10 and crushed by means of the crusher 18. Thus, the lumpy fired pellets having a maximum particle size of 50 mm, in which a plurality of fired pellets were combined into a lump as shown in FIG. 2(A), and the individual fired pellets having a particle size of from 3 to 12 mm as shown in FIG. 2(B) were manufactured.

The properties and the yield of the fired pellets manufactured as described above were as follows:

(1) Reduction index (RI): 87%

The reduction index was measured by a method specified in JIS (Japanese Industrial Standards), which comprises: reducing the fired pellets in an amount of 500 g charged into an experimental electric furnace by means of a reducing gas comprising 30 vol. % CO and 70 vol. % $N_2$ at a temperature of 900° C. for 180 minutes, and measuring the reduction index of the fired pellets.

(2) Shatter index ($SI_{\pm 5}$) 93%

The shatter index was measured by a method specified in JIS, which comprises: dropping the fired pellets in an amount of 20 Kg four times from a height of 2 m onto an iron plate, sieving the thus dropped fired pellets through a 5-mm mesh screen, and measuring the ratio of particles on the screen.

(3) Reduction degradation index (RDI): 22%

The reduction degradation index was measured by a method specified by the Ironmaking Committee of the Iron and Steel Institute of Japan, which comprises: reducing the fired pellets in an amount of 500 g charged into an experimental electric furnace by means of a reducing gas comprising 30 vol. % CO and 70 vol. % $N_2$ at a temperature of 550° C. for 30 minutes, receiving the thus reduced fired pellets in a drum, rotating the drum by 900 revolutions, sieving the fired pellets taken out from the drum through a 3-mm mesh screen, and measuring the ratio of particles under the screen.

(4) Swelling index (SI): 7%

The swelling index was measured by a method specified in JIS, which comprises: reducing three fired pellets by means of a reducing gas comprising 30 vol. % CO and 70 vol. % $N_2$ at a temperature of 900° C. for 60 minutes, and measuring the ratio of change in volume of the fired pellets between before reduction and after reduction.

(5) Yield: 95%

EXAMPLE 2

The same raw materials as those in Example 1, stored in the storage tanks 1a, 1b and 1c were fed to the mixer 2. Quick lime fine having a particle size distribution as shown in Table 8 stored in the storage tank 1d was added to the raw materials in the mixer 2 in an amount of 6.2 wt. % relative to the amount of the raw materials. Then, the mixer 2 was rotated at prescribed revolutions to form a mixture.

TABLE 8

| Over 1 mm (wt. %) | From over 0.5 mm up to 1 mm (wt. %) | From over 0.125 mm up to 0.5 mm (wt. %) | Up to 0.125 mm (wt. %) |
|---|---|---|---|
| 45.5 | 18.3 | 20.0 | 16.2 |

The mixture formed in the mixer 2 was fed to the first pelletizer 3, and water was added to the mixture in the first pelletizer 3. The mixture thus added with water was formed into green pellets having a water content of 9 wt. %, with a particle size distribution as shown in Table 9, by the first pelletizer 3 rotating at prescribed revolutions.

TABLE 9

| From over 10 mm up to 12 mm (wt. %) | From over 9 mm up to 10 mm (wt. %) | From over 7 mm up to 9 mm (wt. %) | From over 5 mm up to 7 mm (wt. %) | From 3 mm up to 5 mm (wt. %) |
|---|---|---|---|---|
| 5 | 10 | 28 | 45 | 12 |

The thus formed green pellets were fed to the second pelletizer 5, and coke breeze having a particle size distribution as shown in Table 10 stored in the storage tank 6a was fed to the second pelletizer 5. The amount of fed coke breeze was 3.9 wt. % relative to the total amount of the raw materials and the quick lime fine composing the green pellets. The surfaces of the green pellets in the pelletizer 5 were covered with the coke breeze by means of the second pelletizer 5 rotating at prescribed revolutions. The conditions of the first pelletizer 3 and the second pelletizer 5 were the same as those in Example 1.

TABLE 10

| From over 5 mm up to 10 mm (wt. %) | From over 2 mm up to 5 mm (wt. %) | From over 1 mm up to 2 mm (wt. %) | From over 0.5 mm up to 1 mm (wt. %) | From over 0.25 mm up to 0.5 mm (wt. %) | From over 0.125 mm up to 0.25 mm (wt. %) | From over 0.062 mm up to 0.125 mm (wt. %) | up to 0.062 mm (wt. %) |
|---|---|---|---|---|---|---|---|
| 4.8 | 23.8 | 13.0 | 15.9 | 15.5 | 14.5 | 8.3 | 4.2 |

As in Example 1, hearth layer ore stored in the storage tank 19 was fed with a thickness of 50 mm onto the endless travelling grate 10 at the inlet side thereof. Then, the green pellets, of which the surfaces were covered with coke breeze, were fed with a thickness of 400 mm onto the hearth layer ore on the endless travelling grate 10 at the inlet side thereof. The green pellets were caused to travel, on the endless travelling grate 10, sequentially through the drying zone 8a, the ignition zone 8b and the firing zone 8c in this order.

As in Example 1, the drying gas at a temperature of about 250° C. was blown into the drying zone 8a to dry the green pellets travelling through this zone, then the ignition gas was blown into the ignition zone 8b to ignite coke breeze on the surfaces of the green pellets travelling through this zone, and then, high-temperature combustion waste gas produced by combustion of coke breeze on the surfaces of the green pellets was sucked, as the firing gas, through the green pellets travelling through the firing zone 8c to heat the green pellets travelling through this zone to a firing temperature of about 1,400° C., thereby firing the green pellets into the firing pellets.

As in Example 1, large slab-shaped masses of the fired pellets thus obtained were discharged from the downstream end of the endless travelling grate 10 and crushed by means of the crusher 18. Thus, the lumpy fired pellets having a maximum particle size of 50 mm, in which a plurality of fired pellets were combined into a lump as shown in FIG. 2(A), and the individual fired pellets having a particle size of from 3 to 12 mm were manufactured.

The properties and the yield of the fired pellets manufactured as described above were as follows:

(1) Reduction index (RI): 84%
(2) Shatter index ($SI_{\pm 5}$): 94%
(3) Reduction degradation index (RDI): 24%
(4) Swelling index (SI): 6.5%
(5) Yield : 92%

According to the method of the present invention, as described above, the fired pellets high in reduction index and shatter index and low in reduction degradation index and swelling index can be manufactured at a high yield.

According to the method of the present invention, as described above in detail, it is possible to manufacture economically and continuously the fired pellets at a high yield, which have a high strength and an excellent reducibility, and do not impair smooth passage of a reducing gas in the blast furnace, and it is also possible to prevent the green pellets from disintegration during transferring and firing thereof, thus providing industrially useful effects.

What is claimed is:

1. A method for continously manufacturing fired pellets, comprising the steps of:

using raw materials comprising a first iron ore fine of from 30 to 70 wt. % and a second iron ore fine of from 70 to 30 wt. %, said first iron ore fine comprising an iron ore fine of from 50 to 80 wt. % having a particle size of up to 0.044 mm and an iron ore fine of from 50 to 20 wt. % having a particle size of from over 0.044 mm up to 0.5 mm, said second iron ore fine comprising an iron ore fine of from 40 to 70 wt. % having a particle size of from over 0.5 mm up to 8 mm and an iron ore fine of from 60 to 30 wt. % having a particle sizee of up to 0.5 mm;

blending said first iron ore fine and said second iron ore fine so that the thus blended raw materials totally have the following particle size distribution:

(1) up to 0.044 mm: from 23 to 48 wt. %,
(2) from over 0.044 mm up to 0.125 mm: from 17 to 25 wt. %,
(3) from over 0.125 mm up to 0.5 mm: from 10 to 20 wt. %,
(4) from over 0.5 mm up to 1.0 mm: from 4 to 10 wt. %,
(5) from over 1.0 mm up to 2.00 mm: from 7 to 15 wt. %,
(6) from over 2.00 mm up to 2.83 mm: from 3 to 8 wt. %,
and
(7) from over 2.83 mm up to 8.00 mm: from 3 to 7 wt. %;

adding to said blended raw materials a powdery flux in a prescribed amount comprising at least one of quick lime, slaked lime, limestone and dolomite to form a mixture;

adding water in a prescribed amount to said mixture, and forming said mixture added with water into green pellets having a particle size of from 3 to 12 mm;

covering the surfaces of said green pellets with a powdery solid fuel in an amount of from 2.5 to 4.0 wt. % relative to the total amount of said blended raw materials and said powdery flux;

using an endless travelling grate type firing furnace comprising only one drying zone, an ignition zone following said drying zone, a firing zone following said ignition zone and an endless travelling grate passing sequentially through said zones;

feeding said green pellets onto said endless travelling grate at the inlet side thereof with a thickness of from 300 to 1,500 mm;

causing said green pellets on said endless travelling grate to travel sequentially through said drying zone, said ignition zone and said firing zone in this order;

blowing a drying gas at a temperature of from 150° to 350° C. into said drying zone from above downwardly to dry said green pellets in said drying zone; and igniting said powdery solid fuel on the surfaces of said green pellets in said ignition zone; and downwardly sucking a combustion waste gas produced by combustion of said powdery solid fuel on the surfaces of said green pellets through said green pellets in said firing zone to heat said green pellets in said firing zone to a firing temperature, thereby firing said green pellets into fired pellets.

2. The method as claimed in claim 1, wherein:

said raw materials comprise said first iron ore fine in an amount of 40 wt. % and said second iron ore fine in an amount of 60 wt. %.

3. The method as claimed in claim 1, wherein:

the surfaces of said green pellets are covered with a mixture of said powdery solid fuel and a powdery flux.

4. The method as claimed in claim 1, wherein:

a powdery solid fuel is added to said raw materials.

5. The method as claimed in claim 1, wherein:

said combustion waste gas sucked on the downstream side of said firing zone is used as said drying gas which is to be blown into said drying zone.

6. The method as claimed in claim 1, wherein:

at least one of calcium ferrite and slag is formed on the surfaces of said fired pellets in said firing step, which combines a plurality of said fired pellets into a lump.

7. The method as claimed in claim 2, wherein:

the surfaces of said green pellets are covered with a mixture of said powdery solid fuel and a powdery flux.

8. The method as claimed in claim 2, wherein:

a powdery solid fuel is added to said raw materials.

9. The method as claimed in claim 2, wherein:

said combustion waste gas sucked on the downstream side of said firing zone is used as said drying gas which is to be blown into said drying zone.

10. The method as claimed in claim 2, wherein:

at least one of calcium ferrite and slag is formed on the surfaces of said fired pellets in said firing step, which combines a plurality of said fired pellets into a lump.

11. The method as claimed in claim 1 wherein the powdery fuel is coke breeze, coal fine, char fine or powdery petroleum coke.

12. The method as claimed in claim 1 wherein the powdery flux is quick lime, slaked line or a mixture therof.

13. The method as claimed in claim 1 wherein the green pellets are formed with a particle size of 5–10 mm.

14. The method as claimed in claim 2 wherein the powdery fuel is coke breeze, coal fine or powdery petroleum coke.

15. The method as claimed in claim 2 wherein the powdery flux is quick lime, slaked lime or a mixture thereof.

16. The method as claimed in claim 2 wherein the green pellets are formed with a particle size of 5–10 mm.

* * * * *